US006382931B1

(12) United States Patent
Czabala et al.

(10) Patent No.: US 6,382,931 B1
(45) Date of Patent: May 7, 2002

(54) COMPRESSOR MUFFLER

(75) Inventors: Michael P. Czabala, Roswell; Robert W. Murdoch, Woodstock, both of GA (US)

(73) Assignee: Respironics, Inc., Pittsburgh, PA (US)

( * ) Notice: Subject to any disclaimer, the term of this patent is extended or adjusted under 35 U.S.C. 154(b) by 0 days.

(21) Appl. No.: 09/925,981

(22) Filed: Aug. 10, 2001

Related U.S. Application Data

(60) Division of application No. 09/440,519, filed on Nov. 15, 1999, which is a continuation-in-part of application No. 09/030,048, filed on Feb. 24, 1998, now Pat. No. 5,996,731.

(51) Int. Cl.[7] ..... F04B 39/00; F02M 35/00

(52) U.S. Cl. ..... 417/312; 181/229; 181/264

(58) Field of Search ..... 181/229, 214, 181/222, 224, 225, 249, 255, 264, 267, 269, 280, 281; 417/312, 417

(56) References Cited

U.S. PATENT DOCUMENTS 4,450,933 A 5/1984 Fukuoka et al. ..... 181/229
4,693,339 A 9/1987 Beale et al. ..... 181/229
6,126,410 A * 10/2000 Kung et al. ..... 417/312

* cited by examiner

*Primary Examiner*—Khanh Dang
(74) *Attorney, Agent, or Firm*—Michael W. Haas

(57) ABSTRACT

A muffler assembly for muffling noises associated with a compressor. The muffler assembly is mounted on the compressor such that the two move as a solid body. The muffler assembly includes an intake having a hollow interior adapted to receive a first flow of gas from the ambient environment. A baffle disposed in the hollow interior of the intake restricts the flow of gas through the intake. In one embodiment, the baffle defines at least a portion of a plurality of fluid portals that separate the first flow of gas into a plurality of flows of gas as the gas passes from a first side of the baffle to a second side of the baffle. As a result, the first flow of gas is disturbed and noise from the compressor is thereby attenuated. In another embodiment, a plurality of baffles are disposed in the hollow interior of the intake to define a tortuous path for the flow of gas through the intake for attenuating noise.

16 Claims, 7 Drawing Sheets

COMPRESSOR MUFFLER

CROSS REFERENCE TO RELATED APPLICATIONS

This is a Divisional of prior U.S. patent application no. 09/440,519 filed Nov. 15, 1999, which is a Continuation-in-Part (CIP) of prior U.S. patent application no. 09/030,048 filed Feb. 24, 1998 now U.S. Pat. No. 5,996,731.

BACKGROUND OF THE INVENTION

1. Field of the Invention

This invention relates to a muffler system in general, and, more particularly, to an integrated muffler system for decreasing the noise level of a compressor and for manipulating the frequency of the soundwaves associated with the operation of a compressor to produce a more tranquil operating environment.

2. Description of the Related Art

Compressors are utilized for compressing air or other gas at a low pressure, such as atmospheric pressure, to a higher pressure for subsequent use. One such application is the use of a compressor with an oxygen concentrator, where air is drawn into the compressor from the surrounding environment through an inlet port of the compressor and then compressed and passed through an outlet of the compressor to the molecular sieves of the oxygen concentrator.

A compressor includes a housing that houses a connecting rod assembly and a piston assembly which compress the air. The piston assembly generally consists of a compressor head connected to a valve plate, a piston sleeve connected to the valve plate, and a piston within the piston sleeve that moves within the piston sleeve in an up and down cycle. Compressing the gas generates noise from a variety of sources. For instance, running the connecting rod assembly and sucking gas into the compressor during the downstroke of the piston generates noise through the compressor intake port. Many pistons utilize a reed valve in the valve plate for directing the gas flow in and out of the compressor. Air flowing through such a reed valve generates a sound that is continually repeated as a result of the reciprocating motion of the piston. Furthermore, compressing gas during the upstroke of the piston generates a noise that travels back through the compressor intake port, while the turbulent flow of the gas as it travels at high velocity into an output cylinder also generates acoustic noise in a pulse setting fashion. Accordingly, in a conventional compressor assembly, a muffler is generally connected somewhere in the compressor system for muffling the noise of the compressor.

Several attempts have been made to develop a muffler for compressors. Previously, some efforts have included placing foam filters within enclosed chambers with the gas being forced through the filters. While such mufflers generally filter very high frequencies, they have little affect on lower frequency sounds. Furthermore, these assemblies require numerous parts and typically occupy a large amount of space, which adversely impact the desirability of the muffler. Such an assembly is shown in FIG. 1 and described in greater detail below. Another possible disadvantage with such a design is that a trade-off exists between adequately muffling the noise and producing a pressure drop across the muffler. Such a pressure drop decreases the efficiency of the compressor.

Other attempts to reduce compressor noise have utilized non-dissipative mufflers for reducing sound within a specific frequency range. Such mufflers utilize a resonator that is tuned to maximize the amount of attenuation by adjusting the length and diameter of the outlet with respect to the sides of the cylinder chamber. While these types of resonators are effective, they generally require extensive design work on the particular compressor size and then only work on soundwaves of a particular frequency.

While many of these mufflers are believed to reduce the compressor noise, they are generally either difficult to design, only effectively reduce the sound associated with a particular wave frequency, or require many components which result in an increase cost of the muffler in both materials and assembly labor.

Therefore there is a need for an improved compressor muffler for a pneumatic compressor and, especially, for a compressor that is utilized in the home environment for establishing a sound spectrum that is not intrusive to the hearing of individuals.

SUMMARY OF THE INVENTION

Accordingly, it is an object of the present invention to provide a muffler assembly which is easy to manufacture.

Additionally, it is an object of the present invention to provide a muffler assembly which decreases the overall decibel level of the compressor and also improves the sound quality of the noise associated with the compressor.

Furthermore, it is an object of the present invention to provide a muffler assembly that includes a suspended attenuator for reducing the overall decibel level of the compressor by manipulating the amplitude and frequency of the soundwaves associated with a pneumatic compressor.

Furthermore, it is an object of the present invention to provide an effective muffler which does not significantly effect the overall size of a compressor or the cost of manufacturing the compressor.

It is also an object of the present invention to provide an effective muffler that does not create a significant pressure drop, thereby reducing the efficiency of the compressor.

Also, it is an object of the present invention to provide a compressor muffler system having a filter directly mounted on the compressor housing for filtering gas prior to compression.

The above objectives are accomplished according to the present invention by providing an integrated muffler assembly for a compressor that reduces the noise created by the compressor's operation. The muffler assembly is mounted directly onto the compressor housing such that the muffler assembly and compressor housing move as a solid body. The muffler assembly includes an intake having a hollow interior that receives a first flow of gas from the ambient environment. A baffle in the hollow interior of the intake restricts the flow of gas through the intake and defines at least a portion of a plurality of fluid portals. These portals separate the first flow of gas into a plurality of flows as the gas passes from a first side of the baffle to a second side of the baffle, thereby disturbing the first flow of gas and attenuating noise.

In another embodiment of the present invention, a plurality of baffles are provided in the hollow interior of the intake for providing a tortuous path for the flow of gas through the intake, thereby blocking a line of sight for the flow of gas to an intake port of a compressor for attenuating noise.

These and other objects, features and characteristics of the present invention, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention.

DETAILED DESCRIPTION OF THE PRESENTLY PREFERRED EMBODIMENTS OF THE INVENTION

Figure 1:
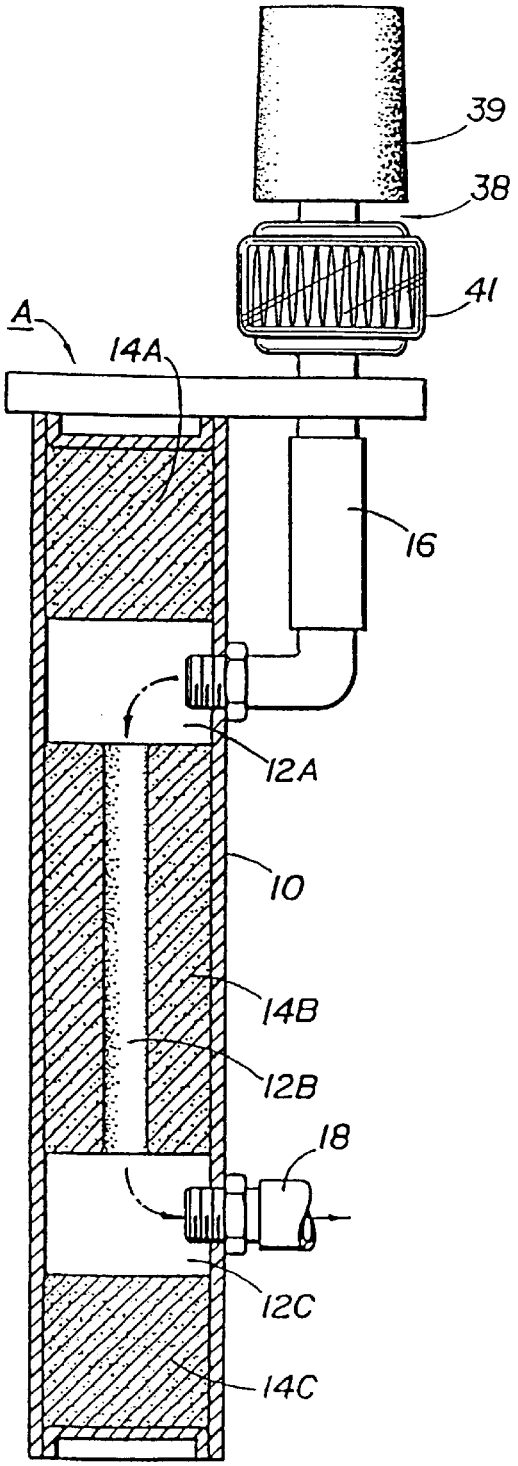
FIG. 1 (PRIOR ART)
FIG. 1 is a side view, partially in section, of a prior art muffler.

Referring now to the drawings, the present invention will be described in more detail. FIG. 1 illustrates prior art muffler A. Prior art muffler A is designed to be utilized with a standard compressor such as a compressor provided by Thomas Industries of Sheboygen Wisconsin. Prior art muffler A includes cylindrical housing 10 that encloses three chambers 12*a*, 12*b*, and 12*c* that are defined between foam filters 14*a*, 14*b* and 14*c*. Muffler inlet 16 communicates air into the muffler and muffler outlet 18 communicates air from the muffler to the compressor (not shown). This design utilizes several separate components that must be coupled to one another to define the entire muffler. It can be appreciated that the use of multiple, separate components adversely affects the cost of the muffler assembly in that additional materials, such as clamps, flexible hoses, seals and other fixtures, are needed to connect the various components of the muffler to the compressor. In addition, the use of multiple, separate components utilizes a lot of space, which is disadvantageous for minimizing the size of the oxygen concentrator unit. This is especially disadvantageous in oxygen concentrators that are intended for home use, where users prefer and demand small, relatively portable units.

Figure 2:
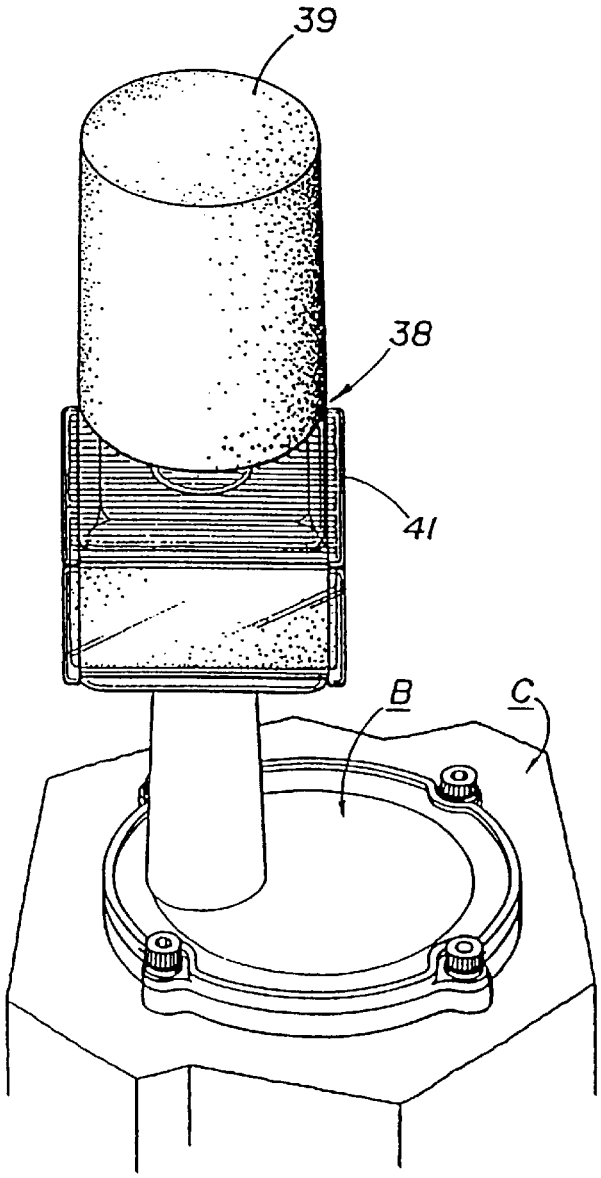
FIG. 2 is a perspective view of a muffler assembly integral with a compressor housing according to the principles of the present invention.

As shown in FIG. 2, muffler assembly B of the present invention, unlike prior art muffler assembly A, is integrated with compressor housing C. That is, muffler assembly B is mounted directly on compressor housing C such that the muffler assembly and the compressor housing move as a solid body. As a result, relatively few parts, such as flexible tubing connecting the muffler and compressor, are required. In addition, because the muffler and compressor move together, there is less likelihood of a disconnection between the muffler and compressor, which can occur as a result of one item moving relative to the other.

Compressor housing C houses a general piston assembly for receiving a gas, such as air, and compressing the air for subsequent use. In the preferred embodiment, the compressor is manufactured by Thomas Industries of Sheboygan, Wisconsin and is utilized as a source of pressurized gas for subsequent use, which may either be an oxygen concentrator or home care respirator. Compressor housing C includes a compressor inlet 20 through which gas is received into the compressor. Muffler assembly B is configured for matingly adapting to compressor housing C in a hermetically sealed manner for assisting in the efficiency of the compressor and also for preventing noise from the compressor from pervading through the ambient environment.

Figure 3:
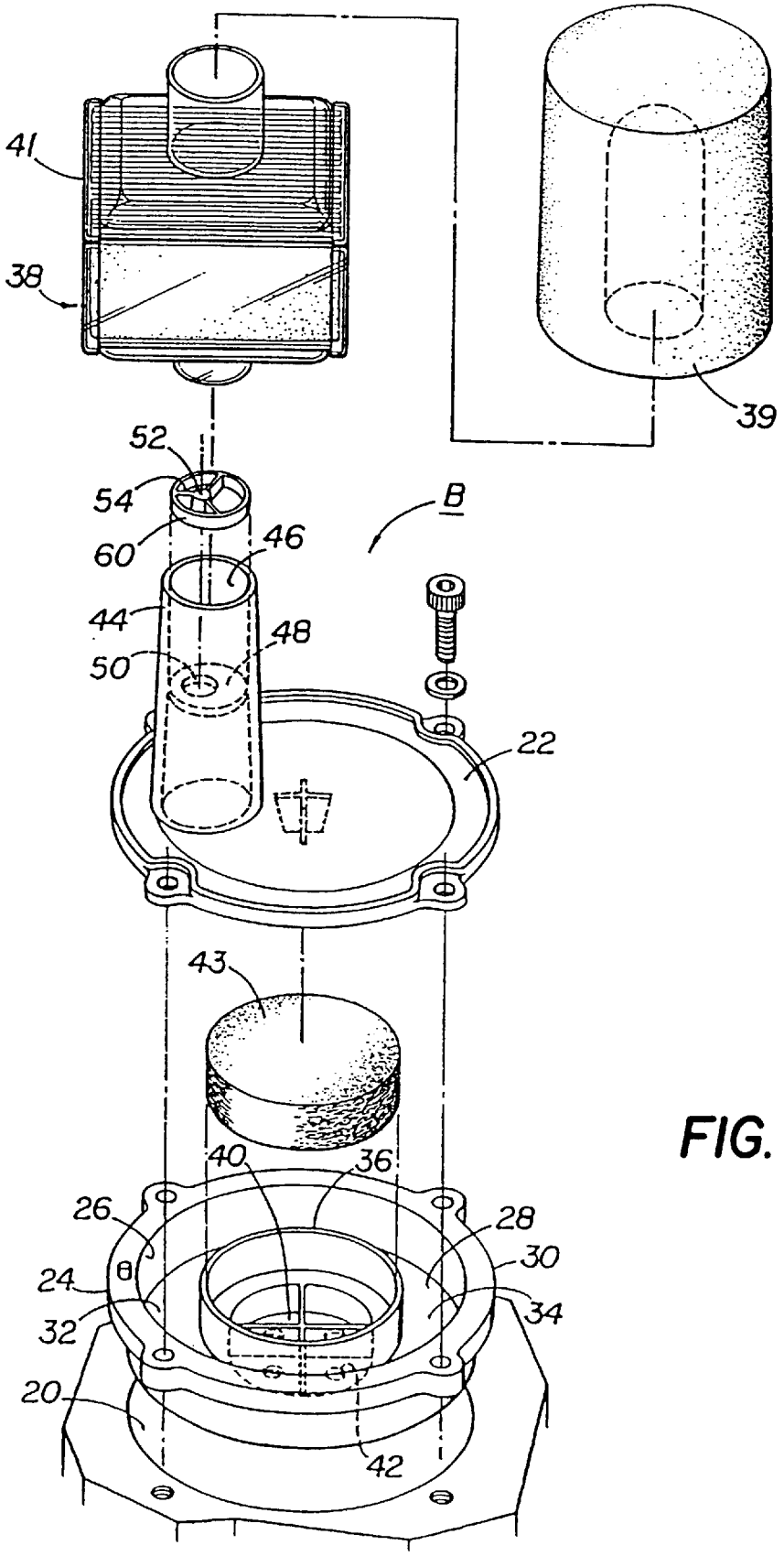
FIG. 3 is an exploded view of a muffler assembly according to the present invention.
Figure 6:
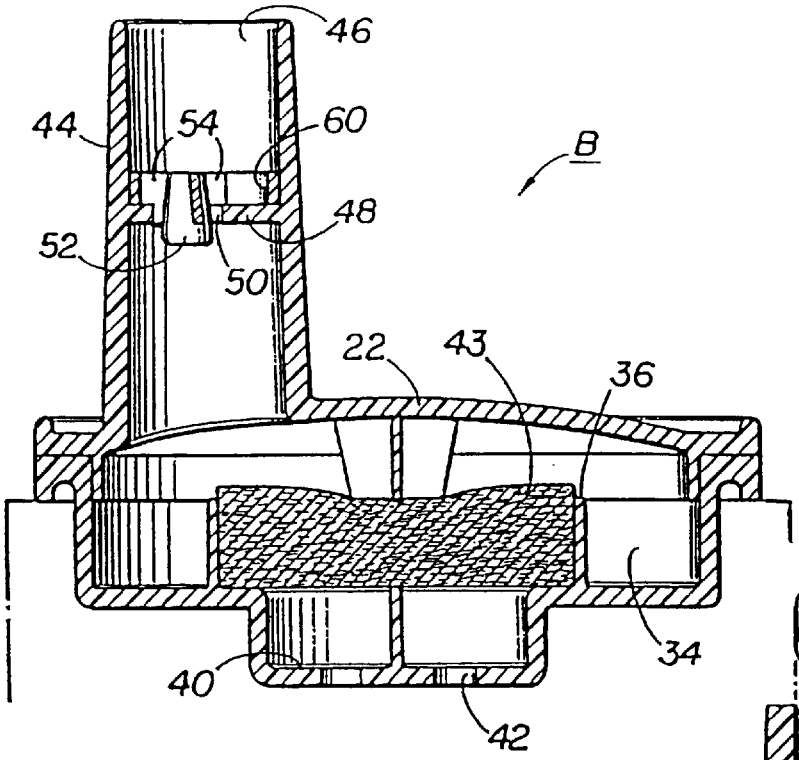
FIG. 6 is a sectional view of a muffler assembly according to the present invention taken along sectional line 6—6 of FIG. 5.

As shown in FIGS. 3 and 6, muffler assembly B provides a tortuous path for gas flowing from the gas source, such as ambient environment, into the compressor. Muffler assembly B includes upper muffler housing member 22 and lower muffler housing member 24. As shown in FIGS. 3 and 6, in an exemplary embodiment of the present invention, upper muffler housing member 22 attaches to a flange 30 on lower muffler housing member 24 to define an acoustical distortion chamber 34. Upper muffler housing member 22 carries intake conduit 44 that defines an intake passageway 46, which fluidly communicates with acoustical distortion chamber 34. Air intake conduit 44 has a smaller cross section than acoustical distortion chamber 34 such that gas flow passing from intake conduit 44 into acoustical distortion chamber 34 is distorted.

In the preferred embodiment, intake conduit 44 is tubular but may consist of any elongated geometric design, such as a rectangle, triangle, hexagonal, or the like. Disposed within the interior of intake conduit 44 is a baffle 48 in which a fluid portal 50 is defined. Baffle 48 transverses the interior of intake conduit 44 for restricting the gas flow within intake passageway 46 and for directing the gas flow through fluid portal 50. An attenuator 52 is suspended within fluid portal 50 for disturbing the gas flow through intake passageway 46. A filter assembly 38 matingly attaches to the top of intake conduit 44 for filtering out large and small particles from the ambient environment prior to entry into the compressor. Filter assembly 38 includes a first filter 39 for filtering large particles and an HEPA filter 41, which removes smaller particles.

As shown in FIGS. 3 and 6, lower muffler housing member 24 includes a general body having an outer sidewall 26 defining a hollow interior 28. Flange 30 extends generally perpendicular from the top of outer sidewall 26 providing a mating surface for attaching to compressor housing C and covering compressor inlet 20. Outer sidewall 26 terminates at bottom muffler wall 32 for enclosing hollow interior 28, which defines acoustical distortion chamber 34. An outlet conduit 36 is disposed within hollow interior 28 and extends upward into acoustical distortion chamber 34 and downward past bottom muffler wall 32 a general distance. Air outlet conduit 36 has a smaller cross section than acoustical distortion chamber 34 for further distorting the flow of gas.

While the present invention has been described above as using upper and lower housing members 22 and 24 to define acoustical distortion chamber 34, it can be appreciated that other configurations for the muffler assembly are contemplated by the present invention. For example, lower housing member 24 can be eliminated with the compressor housing itself being configured to serve as the lower housing member.

Air outlet conduit 36 includes a bottom outlet wall 40 which is porous including a plurality of outlet ports 42 enabling gas to pass through muffler assembly B and into compressor inlet 20. Outlet ports 42 are dispersed at different locations at different quadrants with respect to a filter 43 enabling a large area of filter 43 to be utilized for filtering. Outlet ports 42 are of a sufficient size to prevent a back flow of pressure from gas traversing through outlet conduit 36 but do not, in combination, define an opening that enables a significant level of noise from the compressor to pass from the compressor into the atmosphere back through acoustical distortion chamber 34 or intake conduit 44. Filter 43 is carried within outlet conduit 36 for dampening sound which passes from the interior of the compressor through outlet ports 42.

As illustrated in FIG. 6, fluid portal 50 is smaller in diameter than the interior diameter of intake conduit 44. Attenuator 52 is disposed within fluid portal 50 for attenuating sound waves that travel throughintake conduit 44 and through fluid portal 50. In the preferred illustrated embodiment, attenuator 52 is suspended by a plurality of attenuator support ribs 54 that extend from the periphery of the fluid portal 50 toward the center of the fluid portal. In the preferred embodiment, attenuator 52 is conical with an increasing cross-section. Also, in the preferred embodiment, the volume left unencumbered by the attenuator within the fluid portal is at least equal to the volume of the smallest orifice within the compressor assembly, such that no back log of fluid pressure will occur within the muffler assembly.

Figure 4:
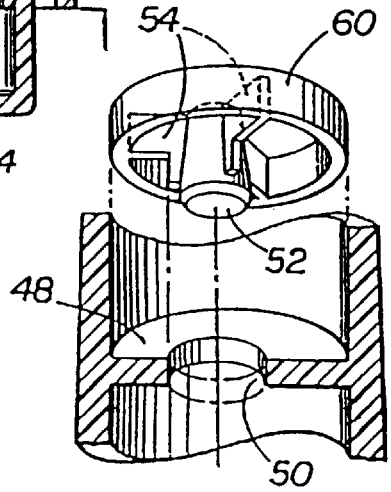
FIG. 4 is a detailed view of an attenuator assembly in the muffler assembly according to the present invention.
Figure 5:
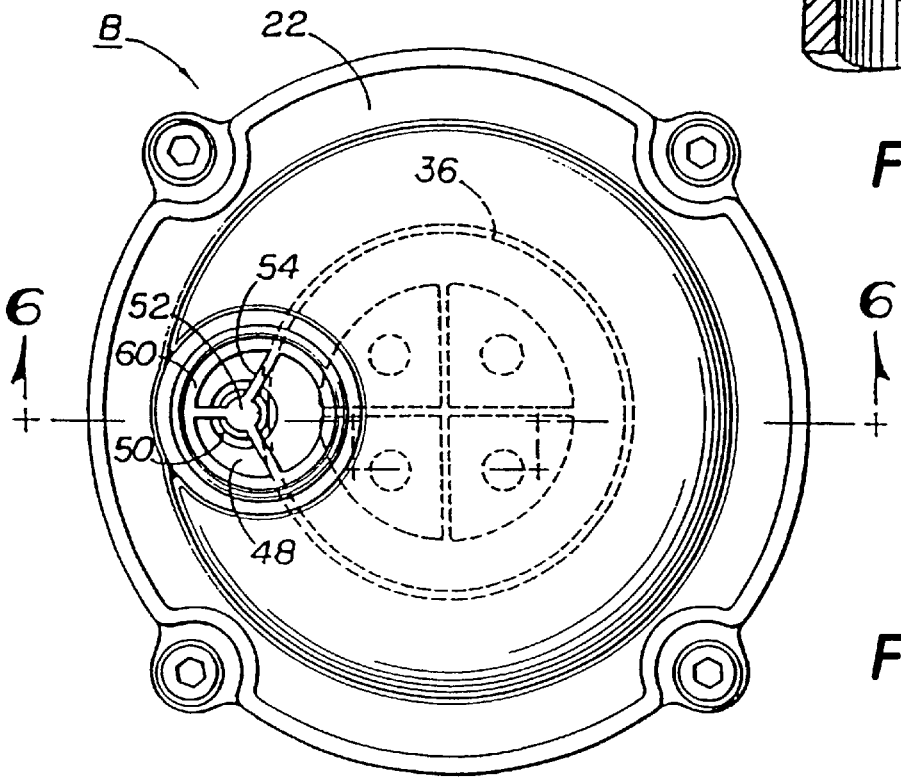
FIG. 5 is a top view of a portion of the muffler assembly according to the present invention.

As shown in FIG. 4, in an exemplary embodiment of the present invention, attenuator 52 and attenuator support ribs 54 are carried by a rim 60 constituting an attenuator assembly. In the preferred embodiment, attenuator assembly is molded from a unitary plastic member and is positioned within intake conduit 44 such that rim 60 rests on baffle 48 with attenuator support ribs 54 traversing baffle 48 enabling attenuator 52 to be suspended within fluid portal 50.

In operation, a flow of gas from a gas source, such as the ambient environment, into the compressor passes through several sized chambers. First, the gas passes through intake conduit 44 and through the smaller fluid portal 50, whereby attenuator 52 attenuates the soundwaves. Gas then passes from intake conduit 44 into distortion chamber 34, which is larger than intake conduit 44. From the distortion chamber, gas passes into outlet conduit 36, which is smaller than distortion chamber 34 but larger than intake 44 and through filter 43. After passing through filter 43, the gas is channeled through outlet ports 42. The combination of the different sized chambers with attenuator 52 produces a sound spectrum that is non-irritating to a person. Furthermore, by hermetically attaching muffler assembly B to compressor housing C and utilizing an o-ring (not shown), internal sounds from the operation of the compressor are also restricted from passing into the ambient environment. Furthermore, filter 43 suppresses sound waves which travel from the compressor inlet through outlet ports 42.

The result of partially obstructing fluid portal 50 is that the soundwaves, which are incurred through operation of the compressor, are disturbed such that the amplitude of the respective soundwaves are diminished and the overall frequency spectrum of soundwaves are transformed, such that the longer wave lengths are truncated to produce shorter wave lengths. The transformation and modulation of the soundwaves is produced by the obstruction which dissect the baffle orifice. The overall influence of the attenuator on the soundwaves is exhibited in FIGS. 7 and 8.

Figure 7:
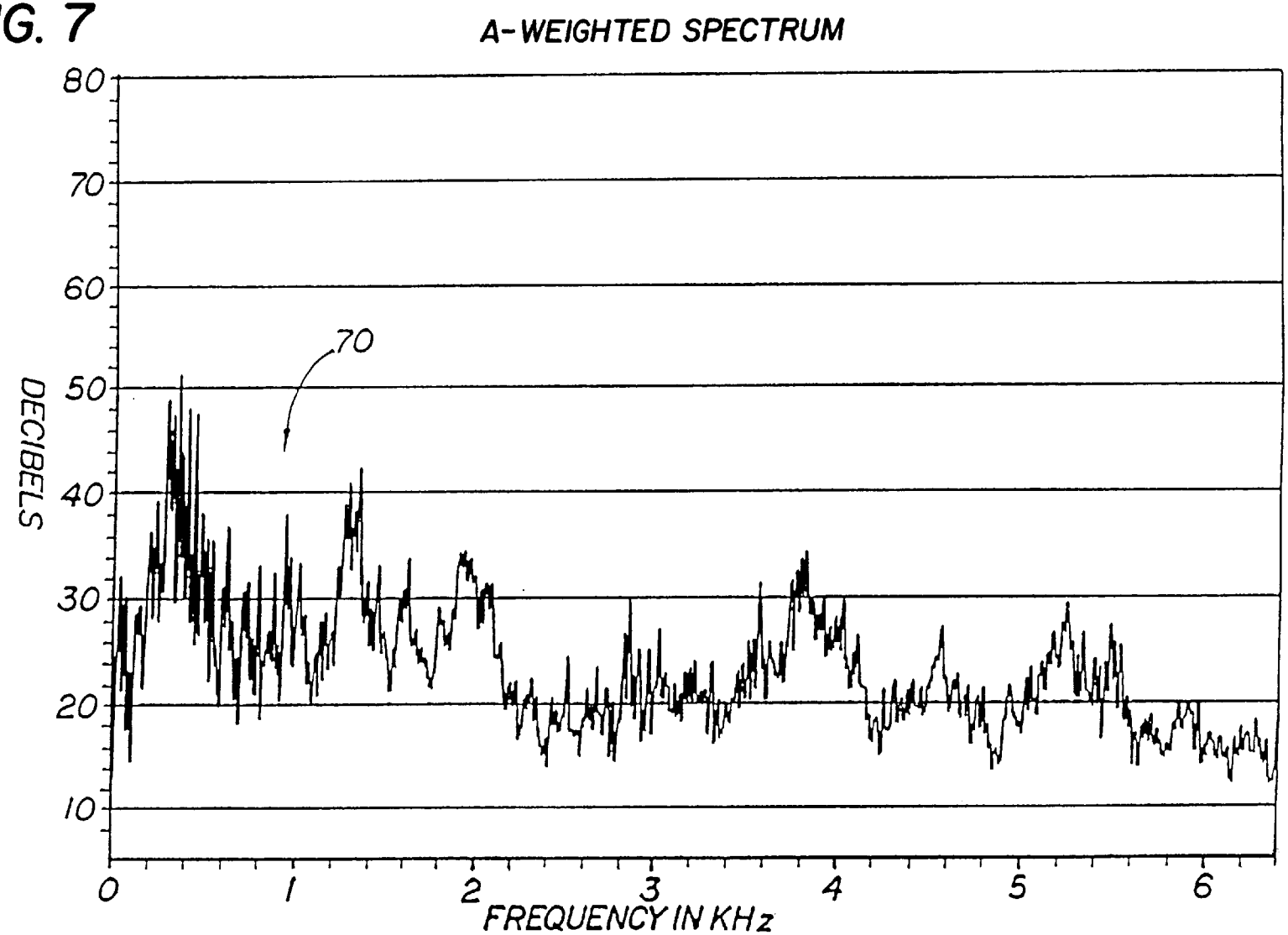
FIG. 7 is a chart illustrating the soundwave spectrum of a standard compressor utilizing a muffler assembly of similar design as the present invention but which does not include an attenuator.
Figure 8:
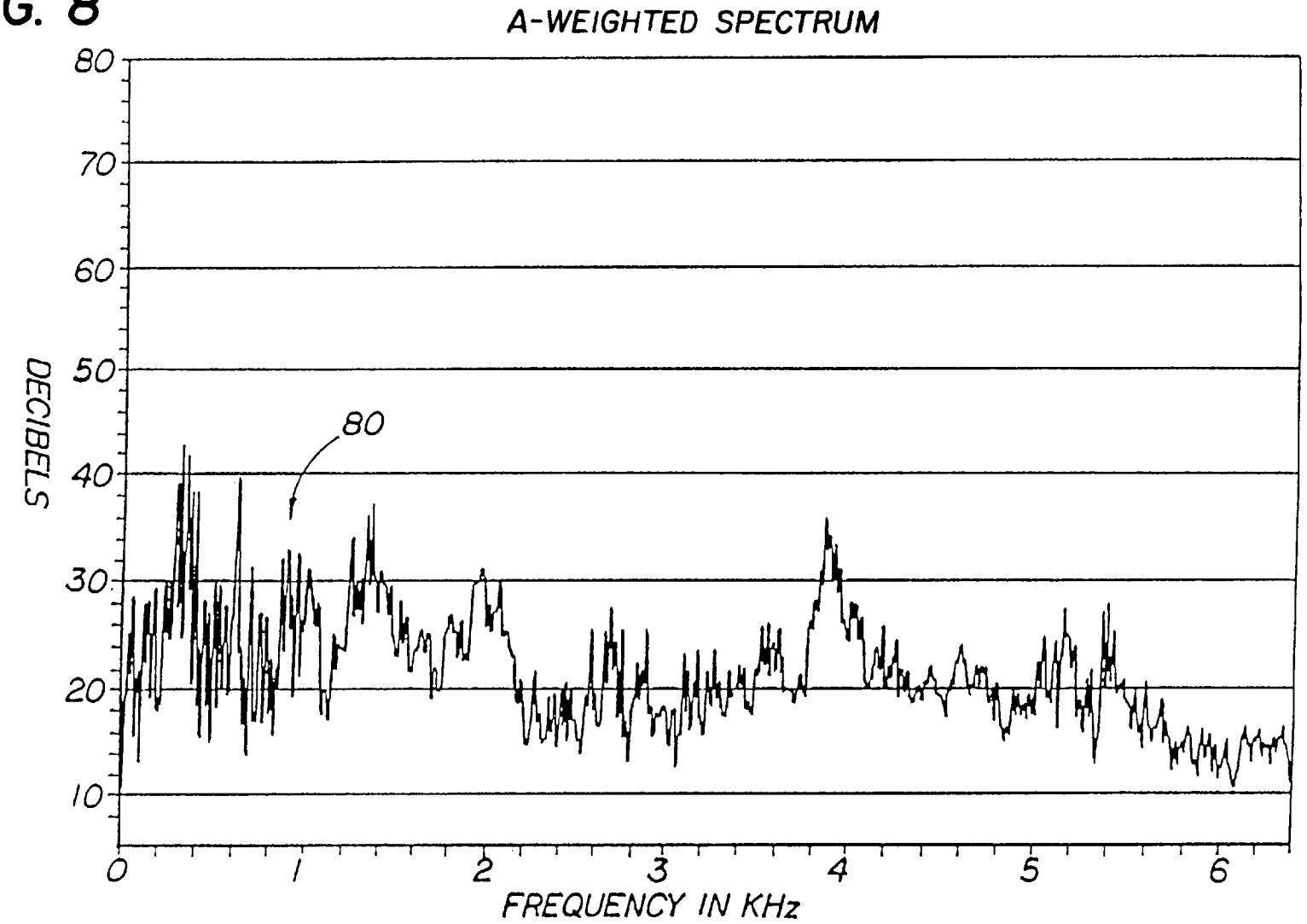
FIG. 8 is a chart illustrating the soundwave spectrum of a standard compressor utilizing a muffler assembly according to the present invention which includes an attenuator.

To illustrate the advantage of the attenuator, tests were run under similar conditions utilizing a compressor and a muffler assembly whereby the sound levels were recorded. FIG. 7 illustrates the spectrum of the soundwaves of an embodiment of a muffler assembly similar to muffler assembly B except it lacked an attenuator, such as attenuator 52. FIG. 8 illustrates the spectrum of the soundwaves of an embodiment of muffler assembly B with attenuator 52. Both spectrums measure the occurrence of frequencies along the X-axis and the adjusted A-weighted sound level along the Y-axis. An A-weighted scale is common in the acoustical field for indicating the overall noise level of the sound. The premise behind an A-weighted scale is that the human ear does not respond equally to frequencies, but is less efficient at low and high frequencies than it is at medium frequencies with lower and higher frequencies being more irritating to a person. Thus, to obtain a single number representing the sound level of a noise containing a wide range of frequencies in a manner representative of the ear's response and overall comfort level, it is necessary to reduce the effects of the low and high frequencies with respect to the medium frequencies. The resultant sound level is said to be A-weighted.

As shown in FIG. 7 the non-attenuated muffler produced a sound spectrum which has an A-weighted sound level of fifty-eight point eight dBA. However, the attenuated muffler A as illustrated in FIG. 8 produced a sound spectrum which has an Aweighted sound level of fifty-three point eight dBA resulting in a reduction of five dBA. As noted by an OSHA study, a five dBA noise reduction equates to an environment that is about thirty percent quieter and represents a fifty percent decrease in the risk of hearing loss.

Also, as illustrated by FIGS. 7 and 8, when comparing the respective sound spectrums it is shown that the A-weighted dBA level for frequencies equal or less than one thousand hertz is significantly reduced illustrating that the attenuator has disturbed wavelengths of these frequencies in both amplitude and frequency and transferring the energy to wavelengths of other sizes. The importance of this feat is that the human ear can better tolerate noise within a medium frequency range instead of at high or low frequencies and also these frequencies can be better filtered by materials such as acoustical foams.

The pressure drop resulting at one hundred liters per minute of gas flow from use by assembly B varies depending on the inclusion of attenuator 52 and filter 43. When an attenuator and filter were included within the muffler assembly, the pressure drop is approximately twenty-six point two inches of water. When muffler assembly B includes filter 43, but does include attenuator 52, the pressure drop is approximately nineteen point six inches of water. When no attenuator is present, but filter 43 is utilized, a pressure drop of approximately eleven point nine inches of water resulted. When no filter 43 or attenuator 52 is utilized, the pressure drop in assembly B was approximately six point two inches of water. Thus, the overall assembly does not impact the efficiency of the system.

Thus, it may be seen that an advantageous design for a compressor muffler may be had by employing an attenuator that is suspended within a restricted gas passage for disturbing the gas flow. The positioning of the attenuator results in a sound spectrum with a reduced A-weighted dBA scale resulting in less noise and a noise level that is comfortable with respect to the ambient environment.

Figure 9A:
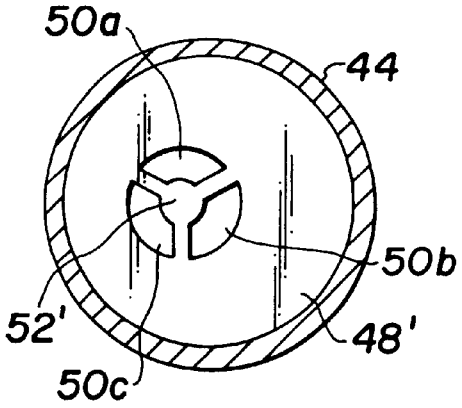
FIGS. 9A–9E illustrate alternative embodiments of the attenuator assembly for use in the muffler assembly according to the present invention.

It can be further appreciated that other various designs may be employed baffle 48, fluid portal 50, and for supporting attenuator 52 within fluid portal 50 in baffle 48. FIGS. 9A–9E illustrate various exemplary alternative configurations for these components of the muffler assembly. FIG. 9A is a top cross-sectional view illustrating the configuration for intake conduit 44, baffle 48', fluid portal 50 and attenuator 52' that correspond, in general, to that shown in FIGS. 3 and 6. In the embodiment of FIG. 9A, however, attenuator 52' and baffle 48' are not separate components. Rather, attenuator 52' is defined by the same material as baffle 48' and is integral therewith. Attenuator 52' is formed as a result of providing a plurality of fluid ports 50*a*, 50*b*, and 50*c* in baffle 48', which together correspond to fluid portal 50 in FIGS. 3 and 6.

In the embodiment shown in FIG. 9A, the entire periphery of each fluid portal 50*a*, 50*b*, and 50*c*, is defined by baffle 48. It is to be understood, however, that the present invention contemplates that only portion of the periphery the fluid portal is formed by the baffle. For example, in FIG. 9B, a first portion of the periphery of each fluid portal 100, 102, 104, and 106 is defined by a side wall 108 of intake conduit 44. A second portion of the periphery of each fluid portal is defined by baffle 110 so that the fluid portals are defined between the baffle and the side wall of intake conduit 44. Of course, the number, size, shape and geometry of fluid portals 100–108 can vary so long as the portals serve to separate the stream of gas flowing through intake conduit 44.

Figure 9B:
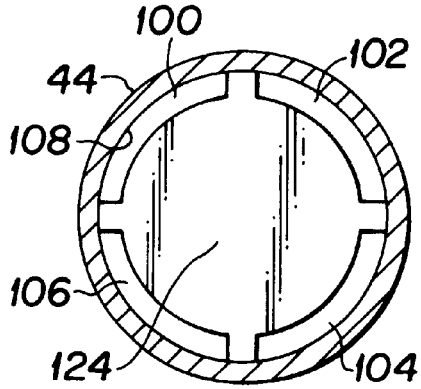
Figure 9C:
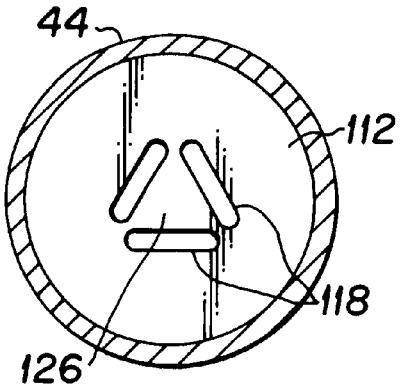
Figure 9D:
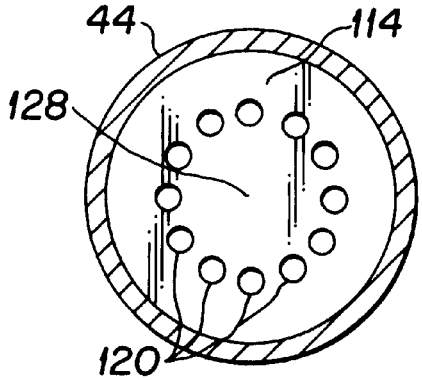
Figure 9E:
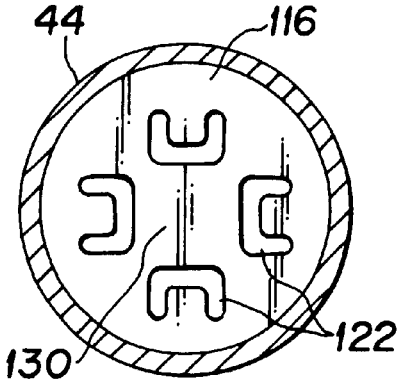

FIGS. 9C–9D illustrate possible variations for the configurations of baffle 112, 114, and 116 and the fluid portals 118, 120, and 122 defined therein. It can be appreciated that the plurality of fluid portals can have a variety of shapes, sizes, numbers and configurations, such as circular (FIG. 9D), oval, elliptical, linear slots (FIG. 9C), or curved slots (FIGS. 9A, 9B and 9E). In addition, each fluid portal need not have the same configuration as the other fluid portals.

In each of these embodiments, as well as those shown in FIGS. 9A and 9B, the plurality of fluid portals are defined in the baffle such that an attenuator 52', 124, 126, 128, or 130 is disposed at a central location amid the plurality of fluid portals. Attenuators 52', 124, 126, 128, or 130 serve the same purpose as attenuator 52 in the previous embodiment. The main difference being that attenuators 52', 124, 126, 128, or 130 are integral with the associated baffle. Attenuators 52', 124, 126, 128, or 130 can have a variety of configurations. However, in a preferred embodiment of the present invention, the attenuator is elongated and has a length that is greater than a length of the plurality of fluid ports.

In the embodiments shown in FIGS. 9A–9E, a single baffle is provided in the gas flow path for reducing the noise in the ambient environment by separating the incoming gas flow into a plurality of flows. It is to be understood, however, that the present invention contemplates other embodiments for the muffler. For example, muffler 132 in FIG. 10A includes a plurality of baffles 134, 136 and 138 provided in a stacked or layered configuration in an intake conduit 140 of the muffler. This configuration for the baffles in the muffler provides a tortuous path, as indicated by arrows C in Fig. IOA, for the flow of gas through intake conduit 140, thereby blocking a direct line of sight for the flow of gas to an intake port of a compressor for attenuating noise. As shown in Figs. 10B–10D, each baffle includes at least one opening or cutout 142 defined therein so that gas can pass from one side of each baffle to the other side. In addition, the baffles are aligned such that the openings do not align, thereby preventing a direct line of sight from an inlet 144 of intake conduit 140 to an outlet 146.

Figure 10A:
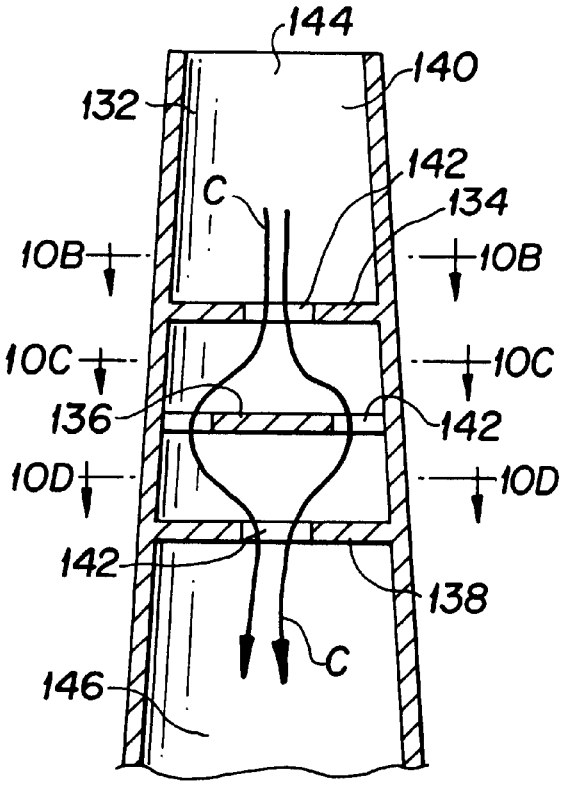
FIG. 10A is a sectional view illustrating a further alternative embodiment of a muffler assembly having a multi-level attenuator assembly.
Figure 10B:
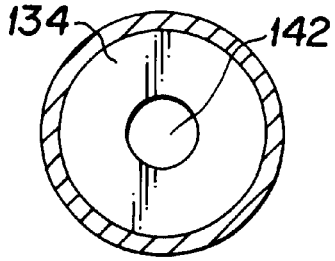
FIGS. 10B—10D are views of the baffles used in the multi-level attenuator assembly of FIG. 10A taken along lines 10B—10B, 10C—10C, and 10D—10D.
Figure 10C:
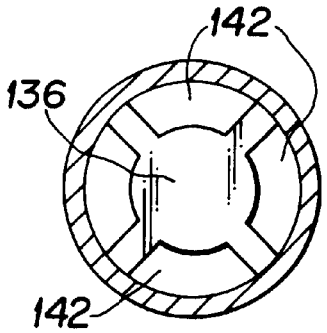
Figure 10D:
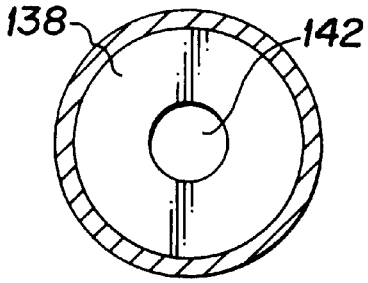
Figure 11:
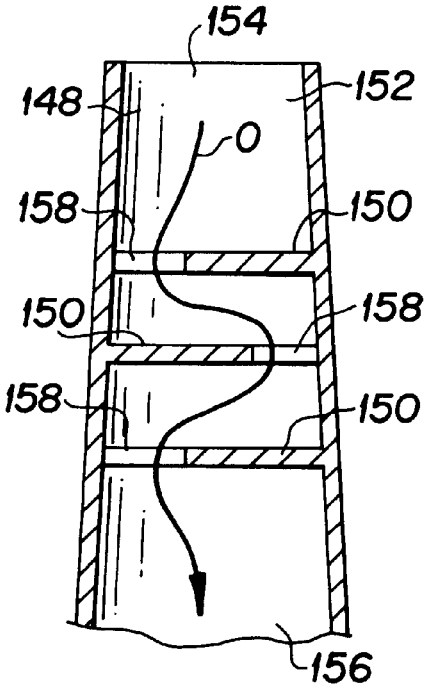
FIG. 11 is a sectional view illustrating yet another alternative embodiment of a muffler assembly having a multi-level attenuator assembly.

FIG. 11 illustrates another embodiment of a muffler 148 in which a plurality of baffles 150 are provided in an intake conduit 152. As in the embodiment of FIGS. 10A–10D, baffles 150 are configured and arranged to define a tortuous path, as indicated by arrow D, between inlet 154 and outlet 156 of muffler 148, so that there is no direct line of sight therebetween. That is, openings 158 in baffles 150 are arranged in intake conduit 152 so that there is no direct alignment of all of the openings in the plurality of baffles. Unlike the muffler shown in FIGS. 10A–10D, baffles 150 in muffler 148 of FIG. 11 do not necessarily include a plurality of opening to separate the flow of gas into multiple flows. Instead, each baffles includes opening or cutout to define openings 158 for the gas flow passage.

While FIGS. 10A–11 show three baffles in the muffler, the present invention contemplates that the multi-layered muffle includes at least two baffles, and can include more than three baffles. Furthermore, the present invention contemplates a variety of configurations for the openings in the baffles in the mufflers shown in FIGS. 10A–11, such as those shown and described above with respect to FIGS. 9A–9E, so long as a tortuous path is defined in the muffler with no direct line of sight between the inlet and the outlet of the muffler.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims.

What is claimed is:

1. An oxygen concentrator system comprising:

a compressor having an inlet adapted to receive a flow of gas from an ambient environment and an outlet;

a molecular sieve assembly operatively coupled to the outlet of the compressor, wherein the molecular sieve assembly separates the flow of gas from the compressor into components including a concentrated gas, and wherein the molecular sieve assembly has an outlet that provides a flow of the concentrated gas to a user; and a muffler assembly having an intake port and an outlet port, wherein the outlet port is operatively coupled to the inlet of the compressor, and wherein the intake port is adapted to receive the flow of gas from the ambient environment for subsequent compression by the compressor, the muffler assembly comprising:

an intake conduit having a hollow interior adapted to receive a flow of gas from an ambient environment, and a baffle disposed in the hollow interior of the intake conduit for restricting the flow of gas through the intake conduit, wherein the baffle defines at least a portion of a first plurality of fluid portals that separate the first flow of gas into a plurality of flows of gas as such gas passes from a first side of the baffle to a second side of the baffle, thereby disturbing the first flow of gas for attenuating noise.

2. The oxygen concentrator system of claim 1, wherein a first periphery of the first plurality of fluid portals is defined by a side wall of the intake conduit and wherein a second periphery of the first plurality of fluid portals is defined by the baffle.

3. The oxygen concentrator system of claim 1, further comprising an attenuator disposed relative to the baffle such that the first plurality of fluid portals are defined by a combination of the baffle and the attenuator.

4. The oxygen concentrator system of claim 3, wherein the attenuator is integral with the baffle.

5. The oxygen concentrator system of claim 1, wherein each of the portals in the first plurality of fluid portals has a shape selected from the group consisting of circular, oval, elliptical, linear slots, or curved slots.

6. The oxygen concentrator system of claim 1, where in the muffler assembly includes a compressor interface at the outlet port defining a distortion chamber having a cross section that is larger than a cross-section of the intake conduit, wherein the intake conduit communicates with the distortion chamber.

7. The oxygen concentrator system of claim 1, further comprising a second baffle disposed in the hollow interior of the intake conduit for restricting the flow of gas through the intake conduit, wherein the second baffle defines at least a portion of a second plurality of fluid portals that separate the flow of gas into a plurality of flows of gas, thereby disturbing the first flow of gas for attenuating noise.

8. An oxygen concentrator system comprising:

a compressor including a compressor housing having an intake port adapted to receive a flow of gas from an ambient environment for subsequent compression and an outlet port for delivering a flow of pressurized gas;

a molecular sieve assembly operatively coupled to the outlet port of the compressor to receive the flow of pressurized gas therefrom, wherein the molecular sieve assembly separates the flow of pressurized gas into components including a concentrated gas, the molecular sieve assembly having an outlet that provides a flow of the concentrated gas to a user; and a muffler assembly integral with the compressor housing such that the compressor housing and muffler assembly move as a solid body, the muffler assembly comprising:

an intake conduit having a first end, a second end operatively coupled in a fixed relation to the compressor housing, and a hollow interior adapted to receive a first flow of gas from an ambient environment, and a baffle disposed in the hollow interior of the intake conduit for restricting the flow of gas through the intake conduit, wherein the baffle defines at least a portion of a first plurality of fluid portals that separate the first flow of gas into a plurality of flows of gas as such gas passes from a first side of the baffle to a second side of the baffle, thereby disturbing the first flow of gas for attenuating noise.

9. The oxygen concentrator system of claim 8, wherein a first periphery of the first plurality of fluid portals is defined by a side wall of the intake conduit and wherein a second periphery of the plurality of fluid portals is defined by the baffle.

10. The oxygen concentrator system of claim 8, further comprising an attenuator disposed relative to the baffle such that the first plurality of fluid portals are defined by a combination of the baffle and the attenuator.

11. The oxygen concentrator system of claim 8, wherein the attenuator is integral with the baffle.

12. The oxygen concentrator system of claim 8, wherein each fluid portal in the first plurality of fluid portals has a shape selected from the group consisting of: circular, oval, elliptical, linear slots, or curved slots.

13. The oxygen concentrator system of claim 8, wherein the muffler assembly includes a housing member interposed between the second end of the intake conduit and the compressor housing and directly coupling the intake conduit with the compressor housing, wherein the housing member defines an acoustical distortion chamber having a cross-section that is larger than a cross-section of the intake conduit, and wherein the intake conduit and the intake port of the compressor housing communicate with the acoustical distortion chamber.

14. The oxygen concentrator system of claim 13, wherein the muffler assembly further comprises an outlet conduit disposed at an end of the housing member proximate to the intake port of the compressor housing for channeling a flow of gas from the acoustical distortion chamber into the intake port of the compressor housing.

15. The oxygen concentrator system of claim 14, further comprising a filter disposed within the outlet conduit.

16. An oxygen concentrator system comprising:

a compressor having an inlet adapted to receive a flow of gas from an ambient environment and an outlet;

a molecular sieve assembly operatively coupled to the outlet of the compressor, wherein the molecular sieve assembly separates the flow of gas from the compressor into components including a concentrated gas, and wherein the molecular sieve assembly has an outlet that provides a flow of the concentrated gas to a user; and a muffler assembly having an intake port and an outlet port, wherein the outlet port is operatively coupled to the inlet of the compressor, and wherein the intake port is adapted to receive the flow of gas from the ambient environment for subsequent compression by the compressor, the muffler assembly comprising:

an intake conduit having a hollow interior adapted to receive a first flow of gas from an ambient environment, a first baffle disposed in the hollow interior of the intake conduit for restricting the flow of gas through the intake conduit, wherein the first baffle defines at least one fluid portal, and a second baffle disposed in the hollow interior of the intake conduit for restricting the flow of gas through the intake conduit, wherein the second baffle also defines at least one fluid portal, and wherein the first fluid portal and the second fluid portal are not coaxially aligned with one another so that the flow of gas follows a tortuous path through the intake conduit.

* * * * *